US007125365B2

(12) United States Patent
Krietzman

(10) Patent No.: US 7,125,365 B2
(45) Date of Patent: Oct. 24, 2006

(54) MOVING STICK EXERCISE DEVICE

(76) Inventor: Mark Howard Krietzman, P.O. Box 3185, Palos Verdes, CA (US) 90274

( * ) Notice: Subject to any disclaimer, the term of this patent is extended or adjusted under 35 U.S.C. 154(b) by 98 days.

(21) Appl. No.: 10/813,333

(22) Filed: Mar. 29, 2004

(65) Prior Publication Data

US 2005/0037903 A1 Feb. 17, 2005

Related U.S. Application Data

(60) Provisional application No. 60/494,775, filed on Aug. 13, 2003.

(51) Int. Cl.
*A63B 21/02* (2006.01)

(52) U.S. Cl. ..... 482/112; 482/121

(58) Field of Classification Search ..... 482/72, 482/73, 112, 126, 135, 905, 62, 63
See application file for complete search history.

(56) References Cited

U.S. PATENT DOCUMENTS 2,921,791 A * 1/1960 Berne ..... 482/118
3,467,376 A * 9/1969 Feinberg ..... 273/452
3,662,602 A * 5/1972 Weiss ..... 73/379.08
3,713,653 A 1/1973 Romans
4,249,727 A 2/1981 Dehn
4,517,966 A * 5/1985 von Othegraven ..... 482/122
5,013,034 A 5/1991 March et al.
5,069,448 A 12/1991 Shyu
5,094,446 A * 3/1992 Wiedner ..... 482/72
5,244,444 A 9/1993 Wostry
5,372,564 A 12/1994 Spirito
5,681,246 A 10/1997 Dougherty
5,759,139 A 6/1998 Wright
5,820,520 A 10/1998 Sieber

FOREIGN PATENT DOCUMENTS

FR 2564735 A1 * 11/1985

* cited by examiner

*Primary Examiner*—Stephen R. Crow
*Assistant Examiner*—Allana Lewin

(57) ABSTRACT

An exercise device and method to strength muscles and develop Chi by pushing a movable stick, in a guide housing (body) about a pivot. Resistance may be added to increase the force required to move the stick member along a path.

11 Claims, 8 Drawing Sheets

MOVING STICK EXERCISE DEVICE

RELATED APPLICATION

This patent application claims the benefit of Applicant's provisional patent application entitled "Moving Stick Exercise Device" filed Aug. 13, 2003, Ser. No. 60/494,775 which is hereby incorporated by this reference.

BACKGROUND OF THE INVENTION

1. Field of the Invention

This present invention relates to an exercise device and method of use. More specifically, to a stick member movable on a pivot.

2. Background Art

Tai Chi is a system of controlled movements which when properly executed is believed by practitioners to develop the internal life energy or "Chi" of the practitioners. Tai Chi is suitable for all age groups, is non-jarring and can build stamina and strength. Tai Chi movements derive from a concept of "yin" and "yang" which roughly means opposing forces, smooth fluid controlled movements are a hallmark of Tai Chi. Learning the controlled Tai Chi movements is accomplished through repetitive practice.

Practitioners may engage in a practice known as push-hands in which two practitioners engage in hand to hand pushing contact movement. Benefits of push hands against another force is to develop greater balance and Chi. Tai Chi also provides aerobic exercise, strengthening and muscle development.

It would be useful to engage in push hands type training and exercise without the need for a partner. It would also be a desideratum to have a resistive device to move against while practicing Tai Chi movements.

SUMMARY OF INVENTION

An exercise method which provides for a guided pushing movement against a pivotal stick member.

A device with at least one pivotal stick member mounted movably to a base which is pushed and/or pulled through a range of motion. Changes in the positions of a user (which may include, but is not limited to the arms, legs, and torso) relative to a stick member, can be used to target different muscle groups.

Some exemplary implementations provide a stick device which works against a resistance (which may be provided by instrumentations such as weight, friction, magnetics, hydraulic cylinders, pneumatic cylinders and/or pistons) throughout the range of motion of the device. The resistance is such that if the force on the stick device applied by the user is removed the stick device will remain generally in place and will not be moved due to an elastic force without the user's interaction.

Some exemplary implementations provide a stick device to be restrained, at least in part, against an elastic force. The resistance is such that if the force on the stick device applied by the user is removed the stick device will moved due to an elastic force without the user's interaction.

Some exemplary implementations provide a stick device rotatable about a pivot, from side to side and back again, which requires an active movement of the stick member through the range of motion without restraining a stick against the pull of an elastic force.

Other features and advantages of the present invention will be set forth, in part, in the descriptions which follow and the accompanying drawings, wherein the preferred embodiments of the present invention are described and shown, and in part, will become apparent to those skilled in the art upon examination of the following detailed description taken in conjunction with the accompanying drawings or may be learned by practice of the present invention. The advantages of the present invention may be realized and attained by means of the instrumentalities and combinations particularly pointed out in the appended claims.

Figure 1A:
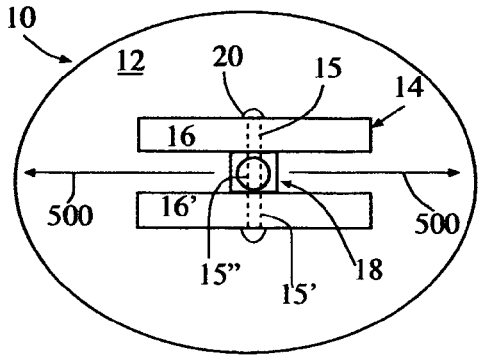
FIG. 1A is a top view of a moving stick exercise device.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

DETAILED DESCRIPTION OF EMBODIMENTS

Detailed embodiments are disclosed herein; however, it is to be understood that the disclosed embodiments are merely exemplary implementations of the invention, which may be embodied in various forms. Therefore, specific structural and functional details disclosed herein are not to be interpreted as limiting, but merely as a basis for claims and as a representative basis for teaching one skilled in the art to variously employ the present invention in virtually any appropriately detailed structure.

Figure 1B:
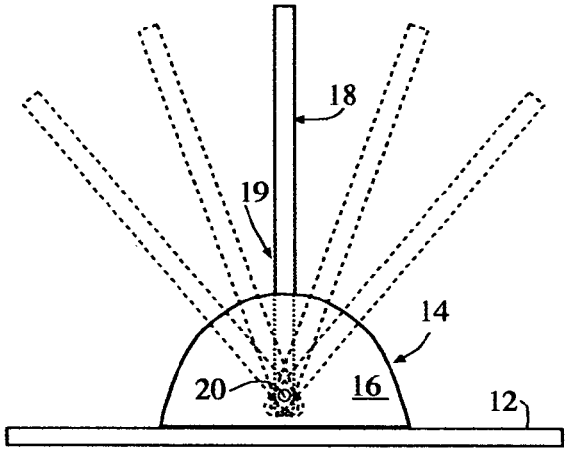
FIG. 1B is a front view of the moving stick shown in FIG. 1A.

Shown in FIGS. 1A–1B is a moving stick exercise device, generally designated 10. A base 12 supports a guide body 14 which is also a support structure. Pivot supporting guides 15, 15" are formed in the guide body 14. The guide body 14 shown is constructed of two side walls 16 & 16', a guide path 500 is shown between the two side walls 16 & 16'. A stick member 18 is held between the two side walls 16 & 16' on a pivot 20 which passes through a pivot supporting guide 15" in the bottom of the lower portion 19 of the stick member 18. The stick member 18 may be constructed of any of rigid, flexible, semi-flexible or semi-rigid materials or combinations thereof. The stick member 18 may be a single part with homogeneous or non-homogeneous flex and stiffness characteristics. The stick member 18 may be constructed of multiple pieces each piece with homogeneous or non-homogeneous flex and stiffness characteristics. A multiple pieces stick member may have the parts affixed together permanently or at least one of the pieces may be removable.

The stick member is connected to the side walls 16 & 16' with a pivot 20 that is supported by the pivot supporting guide 15 and 15' in the side walls 16 & 16'. During use the stick member 18 can be pushed around (rotated) about the pivot 20. The stick member moves around the pivot in the pivot supporting guide 15". The pivot may be affixed firmly in the pivot supporting guide 15" and can rotate within the pivot supporting guides 15 & 15" in the side walls 16 & 16'. Additionally, the pivot may be loose within all pivot supporting guides 15, 15' and 15".

The illustration of a two side walled guide body is not intended as a limitation and substitution of a single support side will provide acceptable results. The illustration of the pivot supporting guides 15, 15' and 15" as channels through the side walls 16 & 16' and bottom portion 19 is not a limitation. Other pivot support structures may include, but not limited to, a receiving slot, opening, cavity, gap, divot, catch, hole, shaped channel, each either through the side walls or partially in the side walls, through the lower portion 19 or partially through the lower portion 19 are also anticipated. Further, although not show, the pivot may extend as part of a side wall or the side walls. The pivot may also extend from the lower portion 19 outward as an extended member.

Figure 1C:
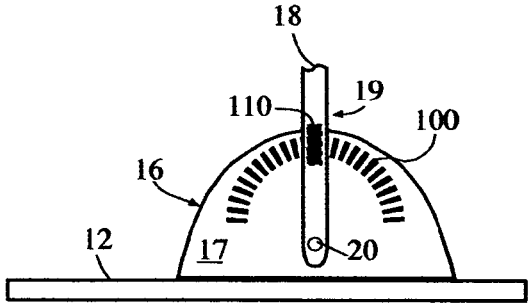
FIG. 1C is a partial interior view of the moving stick exercise device.
Figure 1D:
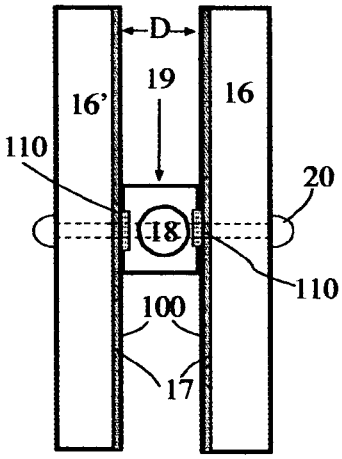
FIG. 1D is a partial top view of the body of the moving stick shown in FIG. 1C.

In FIGS. 1C–1D a region of magnets 100 is place on the inside surface 17 & 17' of at least one of the side wall 16 & 16' shown in FIGS. 1A–1B. A metallic and/or magnetic region 110 attractive to the magnets 100 is placed on the lower portion 19 of the stick member 18 (on the area located within the side walls 16 & 16') generally opposite each region of magnets 100. It is preferable that an air gap be formed between each metallic and/or magnetic region 110 and the opposite region of magnets. The force needed to move the stick member 18 in the guide body 14, along the guide path 500 is greater because of the magnetic attraction between the metallic and/or magnetic region 110 and the magnets 100.

Figure 2:
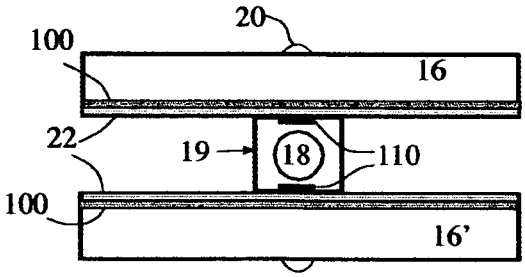
FIG. 2 is a partial view of a moving stick exercise device.

Shown in FIG. 2 is a moving stick member 18. A spacer 22, constructed of a material with a low coefficient of friction and/or high lubricity, that is not metallic or magnetic is placed between the lower region 19 of the stick member 18 and the inside surfaces 17 & 17'. In this embodiment the spacer replaces the air gap. Those skilled in the art will recognize that a spacer 22 may also be used in conjunction with an air gap. In this embodiment the lower region 19 of the stick member 18 and the metallic and/or magnetic region 110 therein move against the spacers 22 when the stick member is moved on the pivot 20. The magnets 100 and the metallic and/or magnetic region 110 interact through the spacers 22 by virtue of a magnetic field.

The magnet 100 and the metallic and/or magnetic region may be reversed with the magnet on the stick member. The resistance function comes from magnetic fields. The interaction of the magnet and the metallic and/or magnetic region is influenced by the shape, size and direction of the magnetic field produced by the magnet(s) and such fields may be influenced by many variables. Variables, include but are not limited to the material of the magnet, the size, shape, volume, position, and orientation of the magnet(s) and the orientation of the magnets with respect to other magnets, size, shape and placement of the magnet and the metallic and/or magnetic region may be varied and such variance may effect the restive force. Magnet to magnet interaction are also anticipated between the magnet 100 and the metallic and/or magnetic region 110 wherein that region is magnetic.

Figure 3:
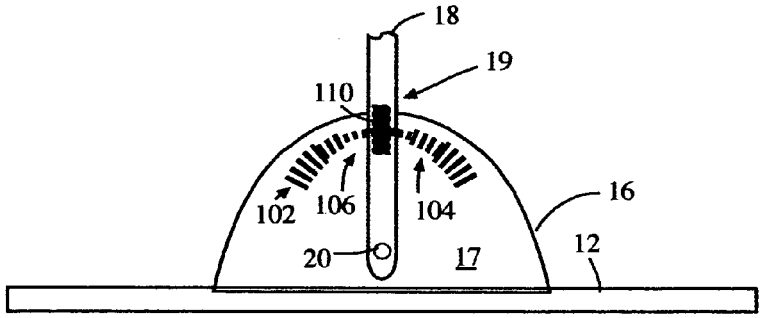
FIG. 3 is a partial view of a moving stick exercise device.

FIG. 3 shows an alternate arrangement of the magnets 100. The magnets in FIG. 3 are constructed in sub-regions. At the sub-regions at the far ends 102 are depicted with the largest magnets. The middle sub-regions 104 have the medium sized magnets and the center sub-region 106 has the smallest magnets.

Those skilled in the art will understand that a large magnet will produce a larger magnetic field than a small magnet with the same magnetic characteristics and that magnets of similar size with greater or lesser magnetic characteristics may be substituted in place of large and smaller magnets with the same magnetic characteristics.

Figure 4:
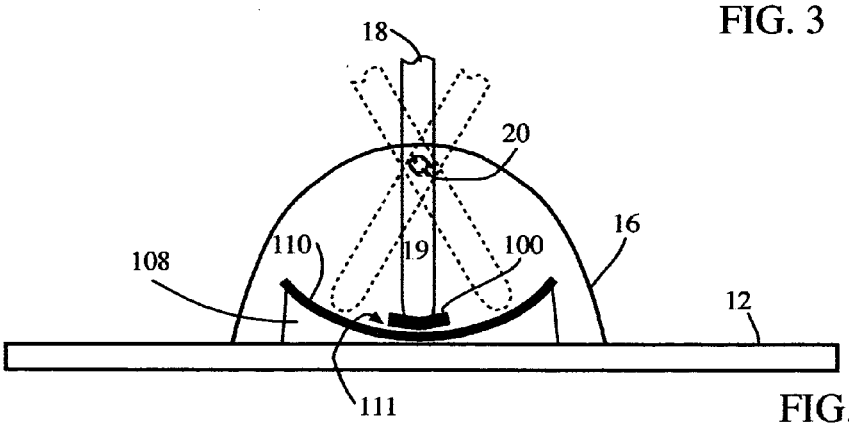
FIG. 4 is a partial view of another a moving stick exercise device.

The embodiment in FIG. 4 shows a stick member on a pivot which extends through the stick member 18 at the lower portion 19 above the bottom. Preferably in the about 2 to about 20 inches above the end of the lower portion 19, more preferably in the about 3 to about 15 inches above the end of the lower portion 19, and most preferably in the about 4 to about 8 inches above the end of the lower portion 19. The magnets 100 are attached at the end of the lower region 19 of the stick member 18. A curved base 108 is used to support a metallic and/or magnetic region 110 attractive, or attracted to, the end magnets 100 which may be metallic and also be magnetized. The stick member 18 moved about the pivot 20. The curved base 108 is oriented to keep the magnets 100 and the magnetic region 110 at a selected gap distance 111. The gap distance 111 may be constant or varied. Varying the gap distance 111 can be used to increase or decrease the interaction between the magnet 100 and magnetic region 110.

Figure 5A:
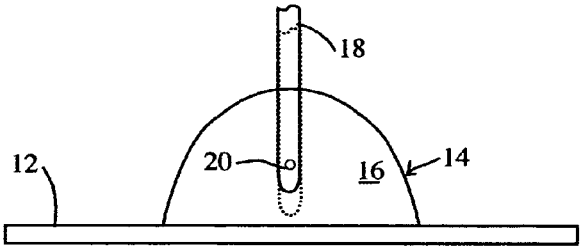
FIG. 5A is a partial front view of a magnetic adjustable body of the moving stick exercise device.
Figure 5D:
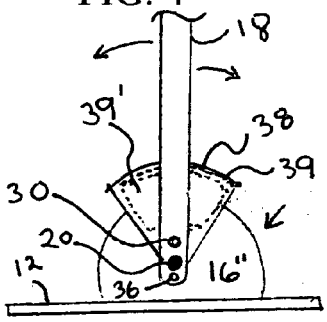
FIG. 5D is a font view the adjustable magnetic a moving stick exercise device of FIG. 5A with magnetic over housing.
Figure 5B:
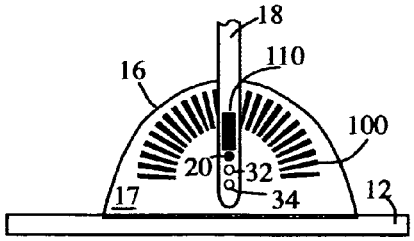
FIG. 5B is an interior view of the adjustable body of FIG. 5A with the stick element in the lower position.
Figure 5C:
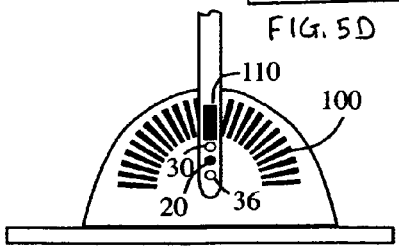
FIG. 5C is an interior view of the adjustable body of FIG. 5A with the stick element in the middle position.

Shown in FIGS. 5A–5C is a guide body 14 with an adjustable height stick member 18. The stick member has multiple guides 30, 32 and 34 through which the pivot can be inserted. Changing a guide 30, 32 or 34 raises (FIG. 5C) or lowers (FIG. 5B) the metallic and/or magnetic region 110 in relation to the magnets 100. The more of the metallic and/or magnetic region 110 which is opposite the magnets 100 the greater the strength of the interaction between the metallic and/or magnetic region 110 and the magnets 100.

The pivot shown in FIGS. 5A–5C is a rigid member constructed of metal, plastic or any other material suitable to support the stick member 18 and allow for smooth movement of the stick member 18. This pivot may be permanently affixed such as a rivet, or bolt with locking nut or it may be removable.

Shown in FIG. 5D is a guide body 14 with a single metallic side wall 16" affixed to a base 12 and a stick member 18. The stick member is shown with multiple guides 30 and 36 through which the pivot can be inserted. Changing a guide through which the pivot 20 is inserted can be used to raise or lower the magnetic over housing 38 which contains magnets 39 & 39 around a portion of the metallic side wall. The closer the magnets 39 & 39' are brought to the metallic side wall the greater the strength of the interaction between the metallic and/or magnetic region.

Figure 6A:
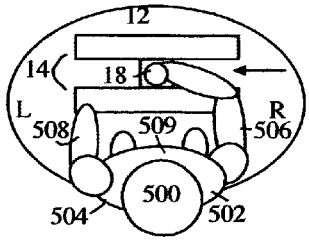
FIGS. 6A through 6K are sequential top views showing the moving stick exercise device.
Figure 6B:
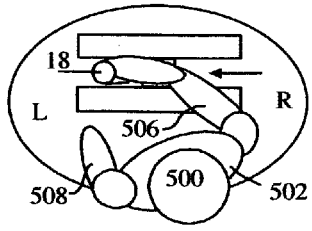
Figure 6C:
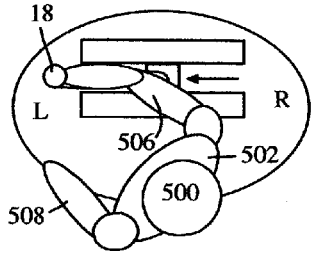
Figure 6D:
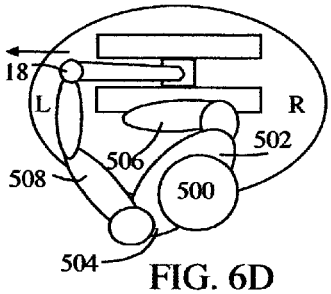
Figure 6E:
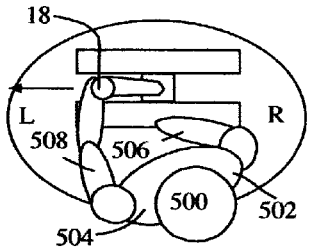
Figure 6F:
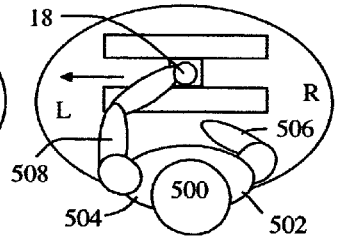
Figure 6G:
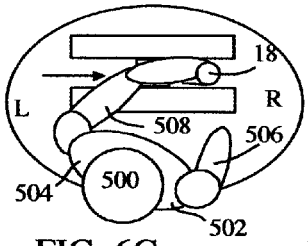
Figure 6H:
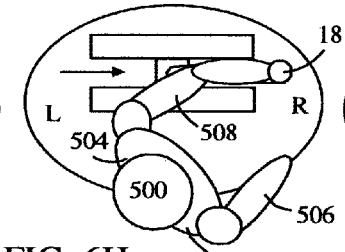
Figure 6I:
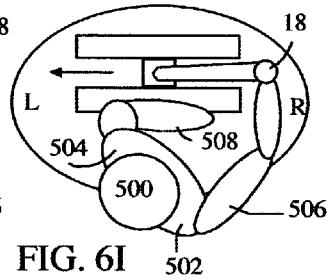
Figure 6J:
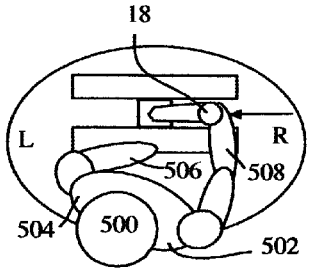
Figure 6K:
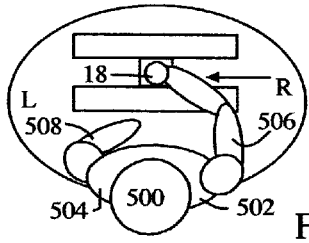

A standing use of the exercise device is shown in FIGS. 6A–6K. FIGS. 6A–6K show a sequence of use. The use of the device, unlike weight lifting, or working against an elastic force, is non-jarring. No active resistance by the user is required to prevent the stick member from moving. Rather the user must actively move the stick member 18. In FIGS. 6A–6K a user 500 stands on the base 12 with shoulders 502 & 504 substantially parallel to the body 14. With the right arm 506 the user pushes on the stick member 18 to the left "L". The left arm 508 is not in use. Next the user rotates the right shoulder 502 towards the left "L" and the stick member 18 is pushed further left "L" FIGS. 6B and 6C. The user then replaces the right arm 506 with the left arm 508 and begins the movement of the stick member 18 towards the right "R" side. The user moves the left shoulder 508 towards the right "R" and also rotates the torso 509 from left "L" to right "R" as the stick member is pushed towards the right "R" (FIGS. 6D–6H). A return stroke then occurs from the far right "R" to the center whereby the user replace the left arm 508 with the right arm 506 and pushes the stick member 18 to center while rotating the torso 509 and right shoulder 502 towards the left "L" (FIGS. 6I–6K).

Figure 7B:
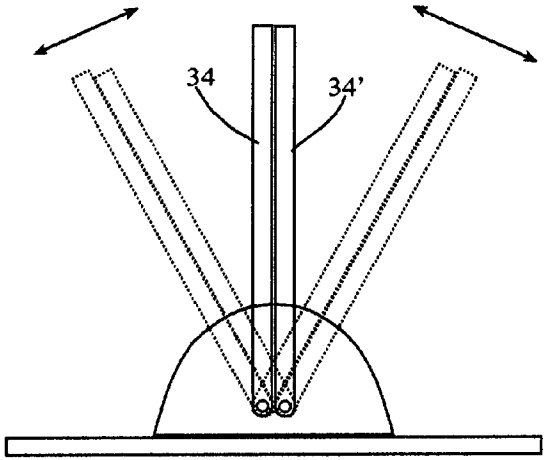
FIGS. 7A & 7B are views of a dual member moving stick exercise device.
Figure 7A:
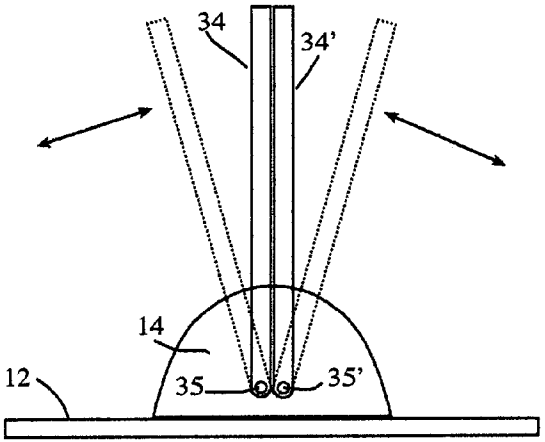
Figure 7C:
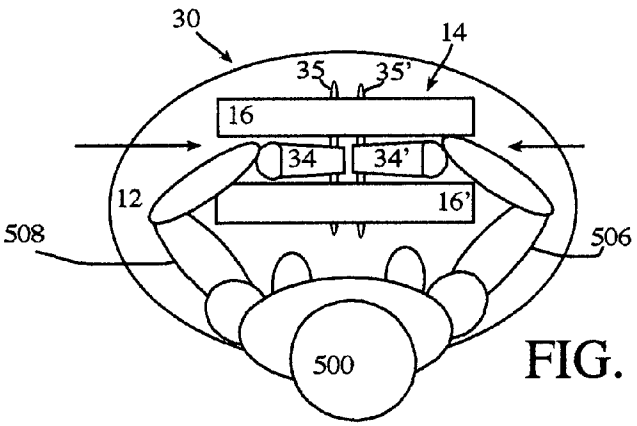
FIG. 7C is a top view showing the moving stick exercise device in FIG. 7A.

A dual stick member, generally designated 30, is shown in FIGS. 7A–7C. a split stick with a left stick 34 and a right stick 34' each supported on a pivot 35 & 35' are shown. The left stick and right stick 34 & 34' may be moved apart (FIGS. 7A & 7C) or together (FIG. 7B). Not shown in FIGS. 7A–7C are metallic and/or magnetic regions on each of the right and left sticks 34 & 34' which interact with the magnets 100 (also not shown) which are placed within the guide body 14 as previously described. A user 500 can practice a push to center exercise shown in FIG. 7C whereby a user 500 moves each left and right stick 34 & 34' towards center by pushing with the left 506 and right 508 arm. Conversely a user may move the left and right sticks 34 & 34' from center outward.

Figure 8A:
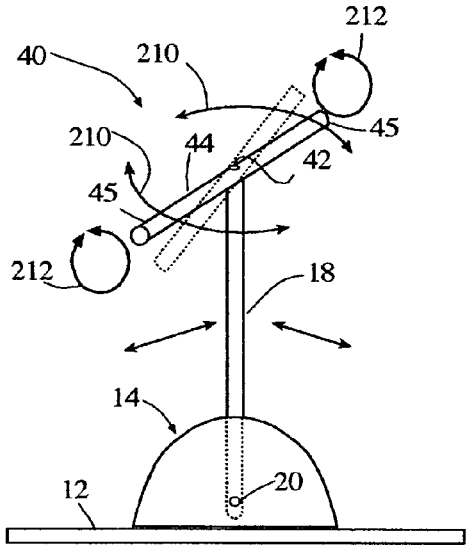
FIG. 8A is a cross member on the top region of a moving stick exercise device.

Shown in FIG. 8A is a moving stick exercise device generally designated 40 which adds a crossbar 42 to the device. The crossbar may be affixed rigidly. However, it is preferred that the crossbar be movable. A crossbar mounting pivot 44 can be used to provide for a movable crossbar 42, shown in FIG. 8A at the top region 46 of the stick member 18. The crossbar mounting pivot 44 movably connects the crossbar 42 to the stick member. The cross bar 42 may have hand grips 45 for a user to hold, or portions of the crossbar 42 can be used as grips.

Placing the crossbar in a sleeve 200 (see FIG. 8E) provides for movement of the crossbar 42 up and down (along arrow 210) the stick member during use. The sleeve 200 may also allow for generally twisting (horizontal) movement around the stick member 18, along the lines of arrow 210. By attaching the crossbar 42, to the side of the sleeve 200, with the crossbar mounting pivot 44, the crossbar 42 can be tilted along the lines of arrow 230. the combination of the movements along the lines of arrows 21, 22, and 230 provide for complex movement of the crossbar 42.

Figure 8B:
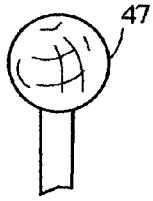
FIG. 8B–8E are additional extended top region elements on a moving stick exercise device.
Figure 8C:
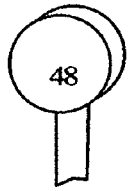
Figure 8D:
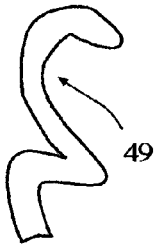
Figure 8E:
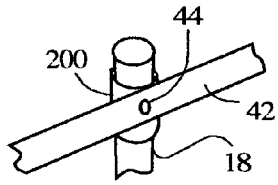

Shown in FIGS. 8B–8D is a partial view of the top region 46 of the moving stick member 18. On the top region 46 a non straight pushing or pulling element or region is formed, or attached. A sphere 47, generally flat area 48 (shown as a disk) and curved region 49 are shown.

Figure 9A:
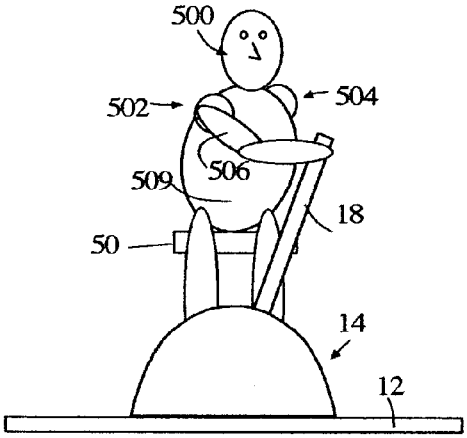
FIGS. 9A–9B are sequential front views showing a sitting method of using moving stick exercise device.
Figure 9B:
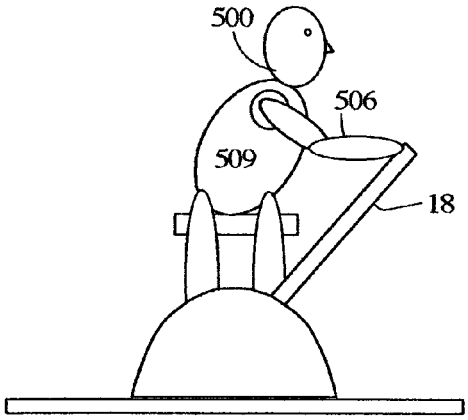

Shown in FIGS. 9A and 9B is a front view of the sequential movement of the stick member 18 from a seated position. A user 500 on a seat 50 pushes the stick member to the user's right. The user's right arm 506 and right shoulder 502 rotate as the stick member 18 is pushed. The torso 509 also twists. Not shown is the return movement wherein the users left arm replaces the right arm and moves the stick the opposite direction turning the left shoulder 504.

Figure 10:
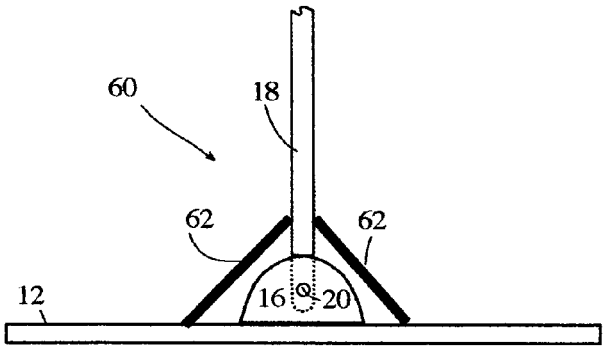
FIG. 10 is a moving stick exercises device.

Shown in FIG. 10 is a moving stick exercise device generally designated 60 in which the resistance on the stick member 18 is provided by elastic straps or bands 62 attached to the base 12 and the stick member 18. The guide body 14 continues to act as a guide for the stick member 18 to move within. The use of elastic bands or straps 62 to create resistance in exercise devices is well known therefore e detailed description of the construction is not provided.

Figure 11:
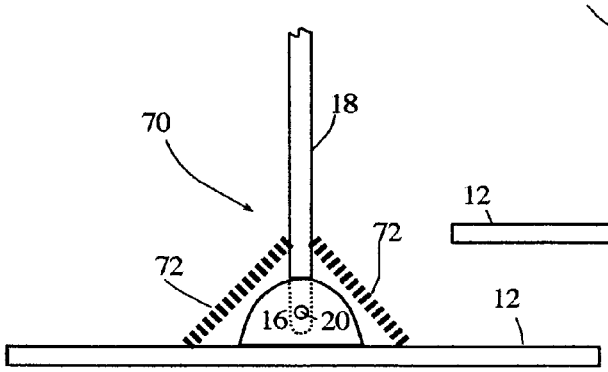
FIG. 11 is a moving stick exercise device.

Shown in FIG. 11 is an a moving stick exercise device generally designated 70 in which a resistance on the stick member 18 is provided by coil springs 72 attached to the base 12 and the stick member 18. The body 14 continues to act as a guide for the stick member 18 to move within. The use of coil springs to create an elastic resistance in exercise devices is well known therefore a detailed description of the construction is not provided. However, this arrangement will place an elastic force which urges the stick member 18 through a movement and which must be resisted by the user.

Figure 12:
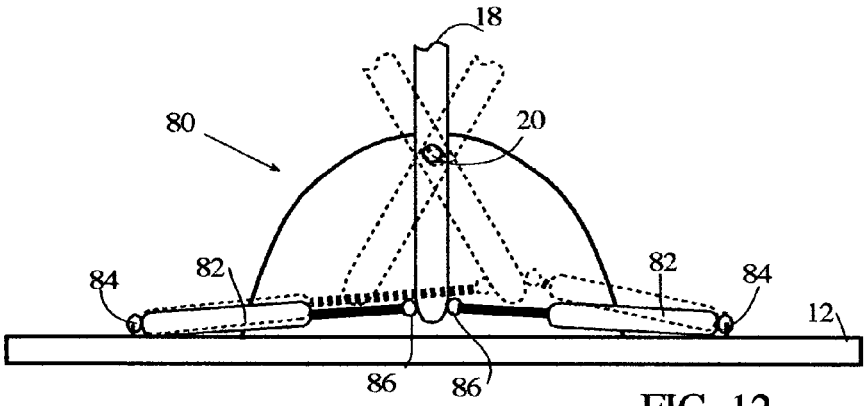
FIG. 12 is a moving stick exercise device.

Shown in FIG. 12 is a moving stick exercise device on a pivot 20 generally designated 80 in which the resistance on the stick member 18 is provided by piston cylinders 82 with rods 83 movably attached with a base mount 84 to the base 12 and to the end of the lower region 19 of the stick member 18 with stick mounts 86, located below the pivot 20. The body 14 continues to act as a guide for the stick member 18 to move. The use of a piston cylinder to create resistance in exercise devices is well known therefore a detailed description of the construction is not provided. Shown are two single action piston cylinders 82 which require force to push the rods 83 into the piston case 87. The piston cylinders shown hereon are hydraulic type sealed piston cylinders. The use of such piston cylinders is not a limitation and adjustable piston cylinders, pneumatic and/or hydraulic are within the scope of this disclosure. Further, the number of piston cylinders shown is not a limitation, a larger or fewer number of pistons may be used depending on the characteristics of the piston cylinder and intended usage.

Figure 13:
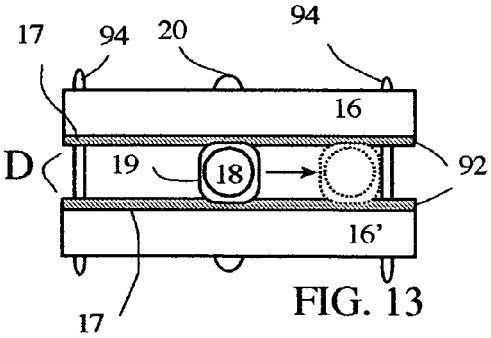
FIG. 13 is a partial top view of a moving stick exercise device.

Shown in FIG. 13 is a moving stick exercise device in which a resistance on the lower region 19 of the stick member 18 is provided by pressure. A low coefficient of friction material 92, such as a high lubricity plastic is affixed to the inside 17 & 17' of the side walls 16 & 16'. The side walls 16 & 16' are affixed to the base and a guide path 15 is formed at a distance "D" which presses against the lower region 19 of the stick member 18 and provides pressure against the lower region 19 creating a resistance making it more difficult to move the stick member 18 along the guide path 500 than in the absence of the pressure. The distance between the side walls 16 & 16' may be fixed or variable. A variable distance can be used to increase or decrease the pressure. Tightening bolts with nuts 94 can be used to adjust the pressure by changing the distance "D".

Figure 14:
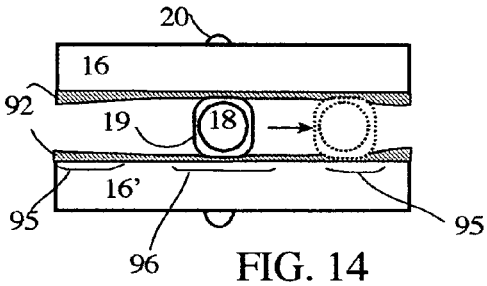
FIG. 14 is a partial top view of a moving stick exercise device.

Shown in FIG. 14 is a moving stick exercise device in which the resistance on the stick member 18 is provided by pressure. A low coefficient of friction material 92, such as a high lubricity plastic is affixed to the inside 17 & 17' of the side walls 16 & 16'. The side walls 16 & 16' are affixed to the base and the guide path 500 is formed at a distance "D" which provides pressure against the lower region 19 of they stick member 18. The thickness of the material 92 is varied with thicker 95 and thinner 96 regions. The distance between the side walls 16 & 16' is varied due to the thickness of the material 92. The changing distance "D" provides changing pressure (and resistance) against the lower region 19 of the stick member, thereby requiring varied force to overcome the resistance as the stick member moves from thicker region 95 to thinner region 96 and vice versa.

Figure 15:
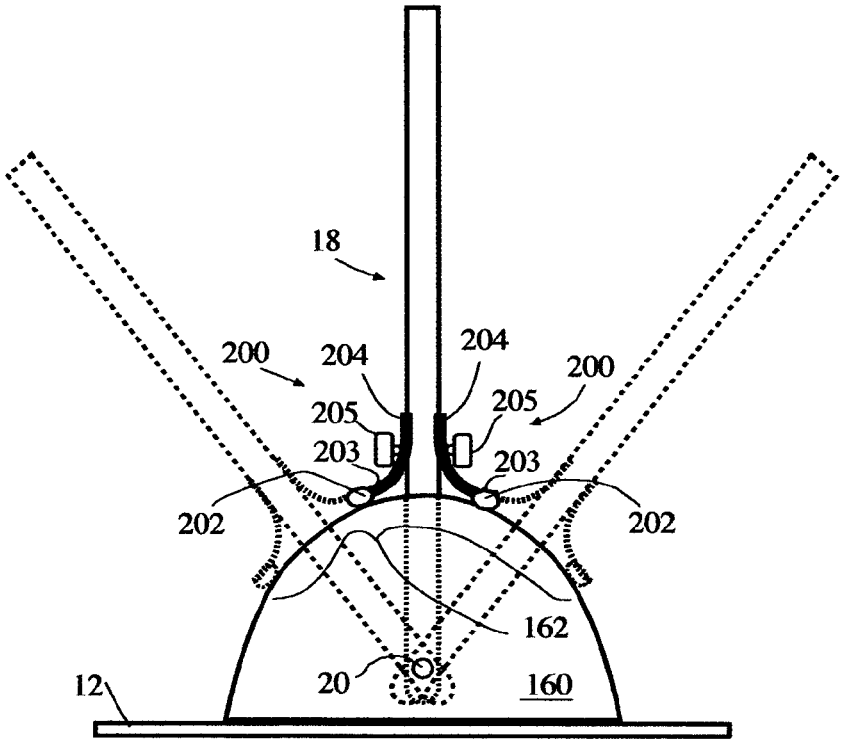
FIG. 15 is a moving stick exercise device.

Shown in FIG. 15 is a moving stick exercise device in which a resistance on the stick member 18 provided by friction. The guide body 140 is constructed of an arched wall 160 attached to a base 12. The stick member is pivotally connected to the guide body 140. Suspension guides 200 which support a brake-type element 202 supported on a first end 203, the second end 204 being connected to the stick member 18. The suspension guides 200 are preferably made of a material with adequate flex so as to place the brake-type element in an under pressure contact with the edge 162 of the arched wall 160. Adjusting the pressure between the brake-type element 202 and the edge 162 can be accomplished by tightening a knob 205 which alters the position of the suspension guides 200 and thereby varies the pressure exerted by the brake-type element 202 on the edge 162.

Figure 16:
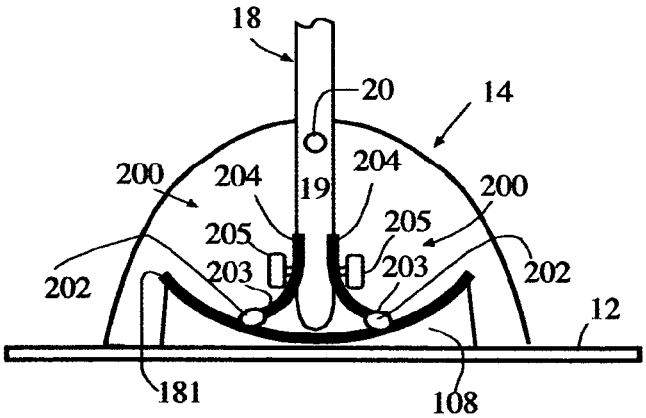
FIG. 16 is a partial front view of a moving stick exercise device.

Shown in FIG. 16 is a moving stick exercise device in which the resistance on the stick member 18 is provided by friction. The guide body 14 is constructed of a single wall 16 (however an opposite second wall may be added) attached to a base 12. The stick member is pivotally connected to the guide body 14 with a pivot 20. Frictional brake-type elements 202, on suspension guides 200, are affixed near the end of the lower region 19 of the stick member 18. Adjusting the pressure between the brake-type element 202 and a raised edge 181 on a curved base 108 can be accomplished by tightening a knob 205 which alters the position of the suspension guides 200 and thereby varies the pressure applied by the brake-type element 202.

Figure 17:
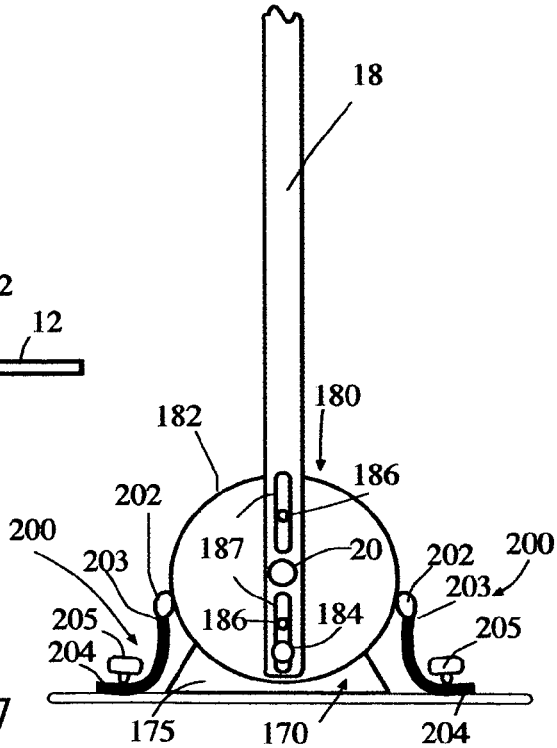
FIG. 17 is a partial front view of a moving stick exercise device.

Shown in FIG. 17 is a moving stick exercise device in which the resistance on the stick member 18 is provided by friction. The guide body 170 is constructed of a single wall 175 (however an opposite second wall may be added) attached to a base 12. The stick member 18 is adjustably connected to a support hub 180 which is pivotally connected to the guide body 170 via a pivot 20. Frictional brake-type elements 202, on suspension guides 200, are affixed to the base 12 against the hub edge 182. Adjusting the pressure between the brake-type element 202 and the hub edge 182 can be accomplished by tightening a knob 205 which alters the position of the suspension guides 200 and varies the pressure exerted by the brake-type element 202 to the hub edge 182. The stick member 18 is affixed to the hub 180 by fasteners 184 within one or more fastening guides 186 accessed through one of a slot 187 formed in the hub 180.

Figure 18:
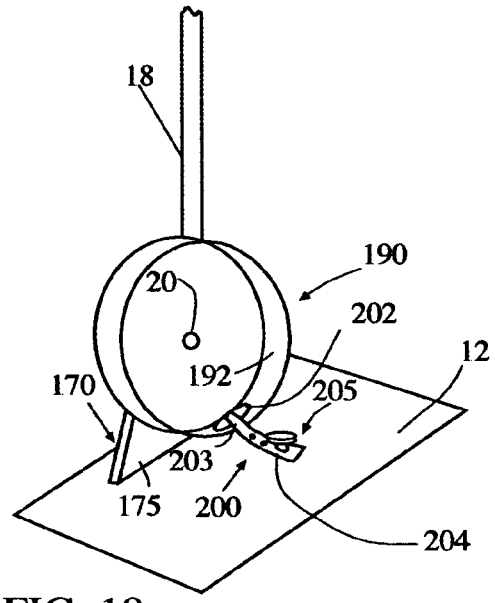
FIG. 18 is a rear perspective view of a moving stick exercise device.

Shown in FIG. 18 is a moving stick exercise device in which the resistance on the stick member 18 is provided by friction. The guide body 170 is constructed of a single wall 175 (however an opposite second wall may be added) attached to a base 12. The stick member 18 is adjustably connected to a rimmed support hub 190 which is pivotally connected to the guide body 170 via a pivot 20. Frictional brake-type elements 202, on suspension guides 200, are affixed to the base 12 against the inner rim edge 192 of the hub 180. Adjusting the pressure between the brake-type element 202 and the inner rim edge 192 of the hub 180 can be accomplished by tightening a knob 205 which alters the position of the suspension guides 200 and thereby varying the pressure applied to the rim edge 192 via the brake-type element 202. The stick member 18 is affixed to the rimmed support hub 190 by fasteners 184 within one or more fastening guides 186 formed in the hub 180.

Figure 19A:
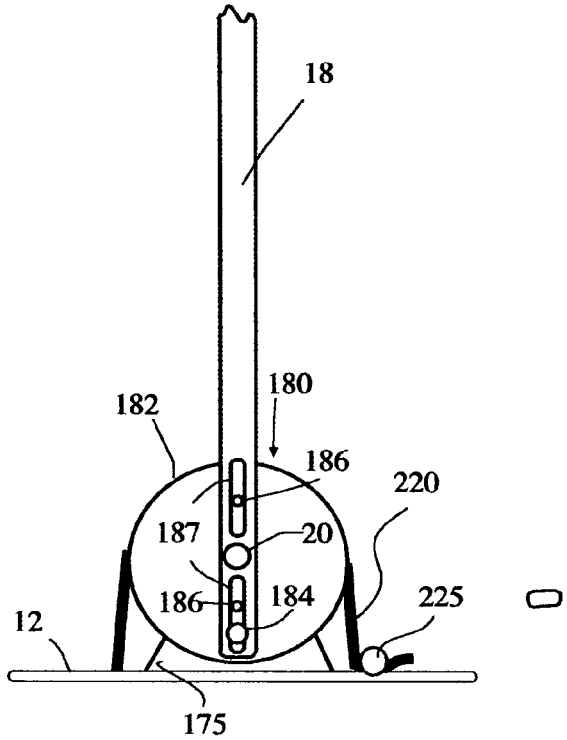
FIG. 19A is a partial front view of a moving stick exercise device.
Figure 19B:
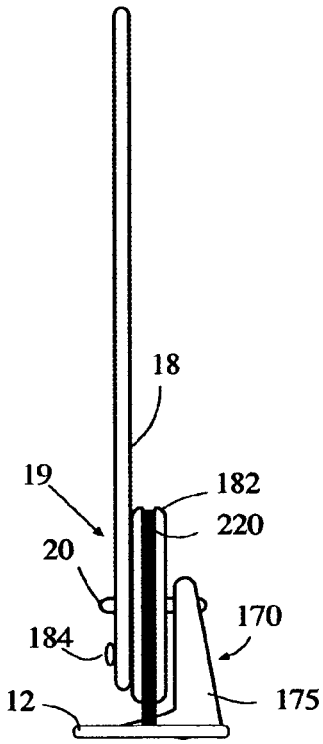
FIG. 19B is a side view of the moving stick exercise device of FIG. 19A.

Shown in FIGS. 19A and 19B is a moving stick exercise device in which the resistance on the stick member 18 is provided by friction. The guide body 170 is constructed of a single wall 175 (however an opposite second wall may be added) attached to a base 12. The stick member 18 is adjustably connected to a support hub 180 which is pivotally connected to the guide body 170 via a pivot 20 in a pivot supporting guide 15. A strap 220 is placed in a channel 222 along the hub edge 182. Adjusting the tension on the strap 220 can be accomplished by tightening a knob 225 which adjusts the tension the strap 220 exerts on the support hub 180. The stick member 18 is affixed to the hub 180 by a fastener 184 within one or more fastening guides 186 formed in the support hub 180. The hub edge and/or the strap 220 should have surface characteristics which provide for a large amount of friction between the hub edge 182 and the strap 220. The strap 220 should be a material durable against the movement of the hub edge against it.

Figure 20:
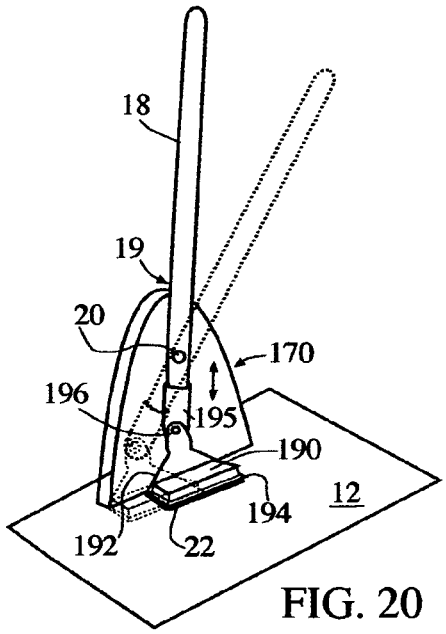
FIG. 20 is a moving stick exercise device.

FIG. 20 shows a weighted moving stick exercise device for guided pushing movement. The weight is moved by pushing. Unlike many weight lifting devices, the weight is not lifted whereby a force is used to resist the weight. The weight is movably attached to the lower region 19 of the stick member. The stick member 18 is connected to the guide body 170 via a pivot 20. The weight is moved across the base 12. The weight 190 is shown on a weight plate 192. the weight plate has a bottom surface 194 on which a spacer 22, constructed of a material with a low coefficient of friction and/or high lubricity, can be attached. A loose connecting sleeve 195 accepts the lower portion 19 of the stick member 18 such that the stick member can slide in and out of the loose sleeve 195. The loose sleeve is connected to a joint 196 which allows the weight plate to keep its bottom surface generally flat against the base 12 during movement of the stick member 18. The amount of weight on the weight plate may be fixed or adjustable.

Since certain changes may be made in the above apparatus without departing from the scope of the invention herein involved, it is intended that all matter contained in the above description, as shown in the accompanying drawing, shall be interpreted in an illustrative, and not a limiting sense.

I claim:

1. A stick member exercise device comprising:

a base;

a guide body connected to the base;

a pivot carried in the guide body; and a stick member having an upper user engageable portion for resistance exercise and a lower portion of the stick member connected to the pivot in the guide body, wherein the guide body constrains movement of the stick member about the pivot to a defined guide path in the guide body, at least one resistance cylinder attached to the lower portion of the stick member below the pivot above the base.

2. A stick member exercise device comprising:

a base;

a guide body connected to the base having a surface defining a guide path;

a stick member having upper user engageable portion for resistance exercise;

a pivot which connects the lower portion of the stick member to the guide body constraining rotational movement of the stick member along the defined guide path; and at least two cylinders each affixed to the lower portion of the stick member below the pivot above the base and affixed opposite one another to the base.

3. The exercise device of claim 2 further comprising a movable crossbar attached to the top region of the stick member.

4. The exercise device of claim 3 further comprising a movable sleeve to which the movable crossbar is attached, whereby the sleeve and crossbar can slide up and down the stick member.

5. The exercise device of claim 1 wherein the defined guide path lies in a plane parallel to a side wall of the guide body.

6. The exercise device of claim 2 wherein the guide path lies in a plane parallel to the surface.

7. A stick member exercise device comprising:

a base;

a guide body connected to the base defining a planar guide path;

a stick member;

a pivot connecting the stick member to the guide body permitting rotational movement of the stick member about the pivot and along the guide path; and at least two cylinders fastened to the stick member above the base between the base and the pivot each operative to oppose pushing force applied to the stick member by a user in a direction away from one of the cylinders.

8. The exercise device of claim 7 wherein the guide body has a first side wall and the guide path is parallel to the first side wall.

9. The exercise device of claim 8 wherein the first side wall is flat.

10. The exercise device of claim 8 wherein the guide body further comprises a second side wall spaced from and parallel to first side wall defining the guide path and wherein the stick member is captured between the first and second side walls by the pivot.

11. The exercise device of claim 2 further comprising a movable crossbar rotatable at least in a plane generally perpendicular to the stick member.

* * * * *